US005132028A

United States Patent [19]

Nagase et al.

[11] Patent Number: 5,132,028

[45] Date of Patent: Jul. 21, 1992

[54] WATER- AND OIL-REPELLENT TREATMENT AGENT

[75] Inventors: Makoto Nagase, Hachioji, Japan; Kathy Allewaert, Heverlee, Belgium; Franceska Fieuws, Brugge, Belgium; Dirk Coppens, Antwerpen, Belgium

[73] Assignee: Minnesota Mining and Manufacturing Company, St. Paul, Minn.

[21] Appl. No.: 624,546

[22] Filed: Dec. 10, 1990

[30] Foreign Application Priority Data

Dec. 22, 1989 [JP] Japan ..... 1-334622

[51] Int. Cl.[5] ..... D06M 10/08; C09D 5/20; C08K 5/34

[52] U.S. Cl. ..... 252/8.6; 106/2; 252/8.7; 252/8.75; 252/8.9; 252/8.8; 524/87

[58] Field of Search ..... 252/8.6, 8.7, 8.75, 252/8.8, 8.9; 106/2; 524/87

[56] References Cited

U.S. PATENT DOCUMENTS

| | | | |
|---|---|---|---|
| 3,256,231 | 6/1966 | Johnson et al. | 260/29.6 |
| 3,282,905 | 11/1966 | Fasick et al. | 260/89.5 |
| 3,341,497 | 9/1967 | Sherman et al. | 260/72 |
| 3,412,179 | 11/1968 | Kleiner | 260/900 |
| 3,420,697 | 1/1969 | Sweeney et al. | 117/121 |
| 3,445,491 | 5/1969 | Pacini | 260/399 |
| 3,470,124 | 9/1969 | Van Eygen et al. | 260/29.6 |
| 3,544,537 | 12/1970 | Brace | 260/89.5 |
| 3,546,187 | 12/1970 | Tandy | 260/80.76 |
| 3,558,549 | 1/1971 | Smith | 260/33.8 |
| 3,639,144 | 2/1972 | Chance et al. | 117/56.8 |
| 3,901,727 | 8/1975 | Loudas | 134/4 |
| 3,922,143 | 11/1975 | Schuster et al. | 8/94.21 |
| 3,931,080 | 1/1976 | Hammer et al. | 260/29.4 |
| 4,004,059 | 1/1977 | Delmer et al. | 428/224 |
| 4,054,592 | 10/1977 | Dear et al. | 560/25 |
| 4,145,303 | 3/1979 | Loudas | 252/156 |
| 4,215,205 | 7/1980 | Landucci | 525/331 |
| 4,426,466 | 1/1984 | Schwartz | 523/455 |
| 4,468,527 | 8/1984 | Patel | 564/96 |
| 4,477,498 | 10/1984 | Deiner et al. | 427/389.9 |
| 4,487,964 | 12/1984 | Watson, Jr. et al. | 564/252 |
| 4,540,497 | 9/1985 | Chang et al. | 252/8.8 |
| 4,560,487 | 12/1985 | Brinkley | 252/8.75 |
| 4,566,981 | 1/1986 | Howells | 252/8.8 |
| 4,587,301 | 5/1986 | Watson, Jr. et al. | 525/123 |
| 4,606,737 | 8/1986 | Stern | 8/115.6 |
| 4,668,406 | 5/1987 | Chang | 252/8.75 |
| 4,820,863 | 4/1989 | Taylor | 560/115 |
| 4,910,339 | 3/1990 | Henning et al. | 564/252 |

FOREIGN PATENT DOCUMENTS

| | | |
|---|---|---|
| 0121083 | 2/1984 | European Pat. Off. . |
| 0241804 | 3/1987 | European Pat. Off. . |
| 0277361 | 12/1987 | European Pat. Off. . |
| 0274492 | 1/1988 | European Pat. Off. . |
| 3512918A1 | 10/1986 | Fed. Rep. of Germany . |
| 59-21778 | 7/1982 | Japan . |

OTHER PUBLICATIONS

Alger, Mark, "Polymer Science Dictionary," Elsevier Applied Science (1989), p. 317.

"Encyclopedia of Polymer Science and Engineering," Supplement Volume, p. 569, John Wiley & Sons (1989).

Banks, R. E., "Organofluorine Chemicals and their Industrial Applications," Ellis Horwood Ltd., Chichester, England, 1979, pp. 226-234.

*Primary Examiner*—A. Lionel Clingman
*Assistant Examiner*—William S. Parks
*Attorney, Agent, or Firm*—Gary L. Griswold; Walter N. Kirn; Carole Truesdale

[57] ABSTRACT

Compositions for imparting water- and oil-repellency to fabrics are provided. They contain a fluorochemical water- and oil-repellant agent, a carbodiimide compound, and at least one of the following: plasticizer, metal alcoholate or ester, zirconium salt, alkylketen dimer, aziridine, and alkenyl succinic anhydride. The compositions may also contain a silicone water-repellent.

24 Claims, No Drawings

WATER- AND OIL-REPELLENT TREATMENT AGENT

The present invention relates to a fluorine-type or fluorochemical, water- and oil-repellent treating agent having useful and improved properties for products having fibrous substrates such as silk, wool, cotton, hemp, leather, polyester, rayon, etc.

The use of various fluorochemical compositions on fibers and fibrous substrates, such as textiles, paper, and leather, to impart oil and water repellency is known. See, for example, Banks, Ed., *Organofluorine Chemicals and Their Industrial Applications,* Ellis Horwood Ltd., Chichester, England, 1979, pp. 226–234. Such fluorochemical compositions include, for example, fluorochemical guanidines (U.S. Pat. No. 4,540,497, Chang et al.), compositions of cationic and non-cationic fluorochemicals (U.S. Pat. No. 4,566,981, Howells), compositions containing fluorochemical carboxylic acid and epoxidic cationic resin (U.S. Pat. No. 4,426,466, Schwartz), and fluoroaliphatic alcohols (U.S. Pat. No. 4,468,527, Patel).

U.S. Pat. No. 4,215,205 (Landucci) discloses combinations of fluorochemical vinyl polymer and carbodiimide. The compositions of Landucci are said to impart durable water- and oil-repellency to textiles consisting essentially of synthetic fibers. Some of the carbodiimides utilized by Landucci contain fluoroaliphatic groups. Other carbodiimides utilized by Landucci are aromatic hydrocarbon carbodiimides.

It has been well known that certain fluorochemical compounds exhibit excellent properties as water- and oil-repellent treating agents for textiles. Water- and oil-repellent treating agents for Japanese clothes, especially 100% silk textiles, require the following properties or features:

1) High water- and oil-repellency;
2) Dry cleaning resistance, that is the treated materials retain water and oil repellency after dry cleaning;
3) Soft feeling after water- and oil-repellent treatment;
4) Giving the above properties with single-solution-type treatment solution independently and without the need of any auxiliary treatment; and
5) Safety, especially low skin irritation.

However, as silk is inferior to other fibers in chemical and heat resistance and other characteristics, the conventional water- and oil-repellent treatment agents have many problems and there is no single agent which can impart all the above properties. Because silk is sensitive to heat, it is preferable that treatments for silk become effective without heat-cure or with heat-cure at less than or equal to 90° C.

The present invention is for overcoming conventional disadvantages, and a purpose is to provide a water- and oil-repellent treating agent which can give high water-repellency, high dry cleaning resistance, and soft feeling (or hand) to silk and other textile products with a simple treatment technique using a single-solution type agent.

Briefly, in one aspect, the present invention provides a water- and oil-repellent treating agent for silk, and other fibrous substrates, said treating agent comprises a fluorine-type or fluorochemical, water- and oil-repellent agent, a multifunctional aliphatic hydrocarbon carbodiimide compound, and one or more component selected from the group consisting of a plasticizer, an aziridine, a metal ester or alcoholate, a zirconium salt, an alkylketen dimer, and an alkenyl succinic anhydride. The treating agent of this invention may optionally further comprise a silicone oil.

Surprisingly, it has been found that the water- and oil-repellent treating agent in the invention can give soft feeling (or hand) without the damage of its water-repellent effect even wherein silicone products including silicone-type water-repellents are further added thereto The silicone products have been said to reduce the water-repellent effect with addition into fluorine-type water- and oil-repellent agents.

An important feature of the treating agent of the present invention is that any type of fluorine-type or fluorochemical, water- and oil-repellent agents which are commercially available products may be used.

Any of the known fluoroaliphatic radical-containing agents useful for the treatment of fabrics to obtain oil and water-born stain repellency can be used including condensation polymers such as polyesters, polyamides, polyepoxides and the like, and vinyl polymers such as acrylates, methacrylates, polyvinyl ethers and the like. Such known agents include, for example, U.S. Pat. No. 3,546,187 (Oil-and Water-Repellent Polymeric Compositions); U.S. Pat. No. 3,544,537 (Fluorochemical Acrylate Esters And Their Polymers); U.S. Pat. No. 3,470,124 (Fluorinated Compounds); U.S. Pat. No. 3,445,491 (Perfluoroalkylamido-Alkylthio Methacryles And Acrylates); U.S. Pat. No. 3,420,697 (Fluorochemical Polyamides); U.S. Pat. No.3,412,179 (Polymers of Acrylyl Perfluorohydroxamates); and U.S. Pat. No. 3,282,905 (Fluorochemical Polyesters). Further examples of such fluoroaliphatic radical-containing water- and oil-repellent agents include those formed by the reaction of perfluoroaliphatic thioglycols with diisocyanates to provide perfluoroaliphatic group-bearing polyurethanes. These products are normally applied as aqueous dispersions for fiber treatment. Such reaction products are described, for example, in U.S. Pat. No. 4,054,592. Another group of compounds which can be used are fluoroaliphatic radical-containing N-methylol condensation products. These compounds are described in U.S. Pat. No. 4,477,498. Further examples include fluoroaliphatic radical-containing polycarbodiimides which can be obtained by, for example, reaction of perfluoroaliphatic sulfonamide alkanols with polyisocyanates in the presence of suitable catalysts.

The fluoroaliphatic radical, called $R_f$ for brevity, is a fluorinated, stable, inert, preferably saturated, nonpolar, monovalent aliphatic radical. It can be straight chain, branched chain, or cyclic or combinations thereof. It can contain catenary heteroatoms, bonded only to carbon atoms, such as oxygen, divalent or hexavalent sulfur, or nitrogen. $R_f$ is preferably a fully fluorinated radical, but hydrogen or chlorine atoms can be present as substituents provided that not more than one atom of either is present for every two carbon atoms. The $R_f$ radical has at least 3 carbon atoms, preferably 3 to 20 carbon atoms and most preferably about 4 to about 10 carbon atoms, and preferably contains about 40% to about 78% fluorine by weight, more preferably about 50% to about 78% fluorine by weight. The terminal portion of the $R_f$ radical is a perfluorinated moiety which will perferably contain at least 7 fluorine atoms, e.g., $CF_3CF_2CF_2$—, $(CF_3)_2CF$—, $F_5SCF_2$—, or the like. The preferred $R_f$ radicals are fully or substantially fluorinated and are preferably those perfluorinated aliphatic radicals of the formula $C_nF_{2n+1}$—.

The carbodiimide compounds used as components in the treating agents of the invention are described, for example, in U.S. Pat. No. 4,820,863; European Pat. Publication No. 241,804; European Pat. Publication No. 120,305; European Pat. Publication No. 121,083; European Pat. Publication No. 277,361; European Pat. Publication No. 274,402; German Pat. Publication No. 3,512,918. An example of such compounds is as follows in European Pat. Publication No. 274,402:

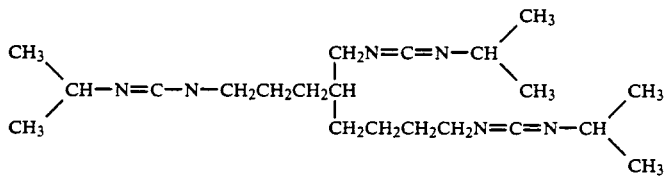

Among the carbodiimides which can be used is UCARLINK TM XL-27HS (available from Union Carbide Corp), a preferred compound because the compound raises (increases) the water-repellency of the agent. One or two or more types of carbodiimide compounds may be used.

The amount of the above carbodiimide compounds used can be selected in a wide range and the most suitable amount may be determined in consideration of dry cleaning resistance and feel (hand) of the treated silk or other fibrous products. For example, the compound may preferably be added in a range of 1–100 weight percent, and in a more preferable range of 3–50 weight percent, based on the weight of fluorochemical agent component of the treating agent.

A third type of compound is used with the above fluorochemical and carbodiimide compounds in the treating agent to fix or obtain the water- and oil-repellent effect of the treating agent at a relative low temperature against silk products. That is, upon application to the fibrous substrate the compositions of this invention require no heat treatment to be effective. These compounds include: plasticizers, metal alcoholates or esters, zirconium salts, alkylketen dimers, alkenyl succinate anhydrides, and aziridines. These compounds may be used independently or more than one compound may be used in combination. To achieve good stability against humidity, the combination of a plasticizer and a zirconium salt is most suitable.

Suitable metal alcoholates or esters include, for example, aluminum isopropylate, mono-sec butoxyaluminium, di-isopropylate, aluminium sec-butylate, aluminium ethylate, aluminium sec-butylate, zirconium butylate, and zirconium propylate These compounds may be metal esters, metal alcoholates, or mixtures.

Suitable zirconium salts include, for example, zirconylacetate, n-zirconyl propionate, n-zirconyl butylate, n-zirconyl valerate, n-zirconylhexanate, n-zirconyl peptanate, zirconyl octylate, zirconyl stearate, and others.

Suitable alkenyl succinic anhydrides include, for example, n-octenyl succinic anhydride, octadecenyl succinic anhydride (commercially available as Paberus TM NP, Pabaerus TM SS-100, and Paberus TM MS-100, manufactured by Mitsubishi Oil Co., Ltd.) and the like.

Suitable aziridine compounds include, for example, beta-aziridinyl methylmethacrylate, n-cyanoethylethyleneimine, octadecyl ethyleneurea, trimethylol propanetris [3-(1-aziridinyl) propionateg], trimethylolpropanetris [3-(1-aziridinyl)butylate], trimethylolpropanetris [3-(1-2-methyl) aziridinyl propionate], trimethylolpropanetris [3-(1-aziridinyl)-2-methylpropionateg], pentaerythritoltris [3-(1-aziridinyl) propionate], pentaerythritoltris [3-(1-(2-methyl) aziridinyl propionate], diphenylmethane-4,4'-bis-N N-ethyleneurea, 1,6-hexamethylene-bis-N N -ethyleneurea, 2,4,6-(riethyleneimino)-syn-triazine, bis [1-(2-ethyl-)aziridinylg]bezen-1 3-dicarboxylate, 1,6-hexamethylene diethyleneurea, diphenylmethane-bis-4,4'-N N -diethyleneurea, 1,1,1-tri(beta-aziridinylpropionylloxymethyl) propane, and others.

Suitable alkylketen dimers include, for example, n-octadecyl alkylketen dimer, (commercial available as Sizepine SPK-900, SPK-901, SPK-902-20 manufactured by Arakawa Chemical Industries Co., Ltd.).

Suitable plasticizers include those which may be described by the formula $RO_2C(CH_2)_nCO_2R$ where R is an alkyl group containing from 1 to 20 carbon atoms, and where n is from 1 to 20. Suitable plasticizers include. for example dioctyladipate, dioctylazelate, di-(2-ethylhexyl)azelate, and di-(2-ethylhexyl) maleate.

The amount of the third compound used varies with the type of compound. The effective or proper amount can be determined in consideration of hand, and the water- and oil-repellency initially and after dry cleaning. The effective amount is generally 1–300 weight %. The preferred quantities of each of the compounds are shown as follows ("weight %" given herein is based on the weight of fluorochemical type repellent agent solid content): Metal alcoholate or ester: preferably 5–200 weight %, more preferably 10–100 weight %; Zirconium salt: preferably 10–300 weight %, more preferably 20–100 weight %; Alkenyl succinic anhydride: preferably 5–100 weight %, more preferably 10–30 weight %; Aziridine compound: preferably 1–100 weight %, more preferably 5–30 weight %; Alkylketen dimer: preferably 5–100 weight %, more preferably 10–50 weight %; Plasticizer: preferably 10–200 weight %, more preferably 10–40 weight %.

In the invention, silicone compounds can optionally be added to give soft feeling to silk or other fibrous products processed by water- and oil-repellent agents. It is preferred to use silicone oil (such as SH200 manufactured by Toray Silicone Co., Ltd.) and silicone-type water repellent agent (such as SD200 manufactured by Toray Silicone Co., Ltd.).

For the application of the water- and oil-repellent treating agent, the agent can be used in solvent solution, emulsion and aerosol forms. Commonly the agent is used in single-solution type solvent solution form.

The water- and oil-repellent treating agent of the present invention can be applied using various treating methods such as a solution in a solvent, emulsion or aerosol, but normally used often as a one-pack type solution in a solvent. The solutions are typically, but not limited to, 0.2 to 2% solids Of more importance is the final % solids on the fibrous substrate after treatment and drying The % solids on fabric is preferably 0.05 to 3%.

The treatment of silk or other fibrous substrates using the water- and oil-repellent treating agent of the present invention is carried out by using well-known methods including dipping, spraying, padding, knife coating, roll coating or the like, drying at 90° C or below, including room temperature, e.g. about 20° C, and optionally heat-treating the silk products in the same manner as in conventional textile processing methods.

The structure of silk or other fibrous substrates treated by the water- and oil-repellent agent of this invention is not especially limited and includes textile fabrics, such as woven, knitted, and non-woven fabrics, the products are normally treated in the form of woven fabrics.

Numerical values related to compositions of the water- and oil-repellent agent are wholly based on weight unless otherwise noted.

Respective data of water and oil repellency shown in Examples and Comparative Examples are based on the following methods of measurement and evaluation criteria:

First, the water repellency is measured by the spraying method according to the JIS L-1005, and spray evaluation is made at grades of 0 to 100, which is the highest evaluation (see Table 1).

TABLE 1

| Water Repellency No. | Condition |
|---|---|
| 100 | Without adhered wetting or swelling on the surface |
| 90 | Exhibiting slight adhered wetting and swelling on the surface |
| 80 | Exhibiting partial wetting and swelling on the surface |
| 70 | The surface was swollen |
| 50 | The whole surface was swollen |
| 0 | The surface was wholly swollen to the back of the sample |

Oil repellency is measured by a method according to the AATCC-118-1981. Solvents of different surface tension are placed on the sample and the sample is scored according to the solvent of lowest surface tension that does not penetrate the sample. A treated fabric that is not penetrated by Nujol TM, having the lowest penetrating power, is rated as score 1, and a treated fabric that is not penetrated by heptane, having the highest penetrating power in test oils, is rated as score 8 (see Table 2).

TABLE 2

| Oil Repellency No. | Surface tension (dyne/cm) | Standard test liquid |
|---|---|---|
| 0 | — | Less than 1 |
| 1 | 31.45 | Nujol TM |
| 2 | 29.6 | Nujol TM /n-hexadecane = 65/35 (% by weight) |
| 3 | 27.3 | n-Hexadecane |
| 4 | 26.35 | n-Tetradecane |
| 5 | 24.7 | N-Dodecane |
| 6 | 23.5 | n-Decane |
| 7 | 21.4 | n-Octane |
| 8 | 19.75 | n-Heptane |

COMPARATIVE EXAMPLE C1

A copolymer of 65% by weight of a perfluoroalkylmethacrylate monomer, $C_8F_{17}SO_2N(CH_3)CH_2CH_2O_2CC(CH_3)=CH_2$ and 35% by weight of an alkylmethacrylate monomer, $C_{18}H_{37}O_2CC(CH_3)=CH_2$, and UCARLNK XL-27HS, which is a carbodiimide compound manufactured by Union Carbide Co., Ltd., were added at ambient temperature to 1,1,1-trichloroethane in a weight ratio of 10% copolymer, 1% carbodiimide, and 89% solvent, and then diluted 20-fold with mineral spirit. The copolymer was prepared by the method described in example 6 of U.S. Pat. No. 3,341,497 (Sherman and Smith).

EXAMPLE 1

The copolymer and carbodiimide of Comparative Example C1, and di-2-ethylhexyl azelate (plasticizer) were added as in Comparable Example C1 to 1,1,1-trichloroethane, in a weight ratio of 10% copolymer, 1% carbodiimide, 5% plasticizer, and 84% solvent, and then diluted 20-fold with mineral spirit.

EXAMPLE 2

The copolymer and carbodiimide of Comparative Example C1, and zirconium octylate (Zirconium salt) were added as in Comparative Example C1 to 1,1,1-trichloroethane, in a weight ratio of 10% copolymer, 1% carbodiimide, 10% zirconium salt, and 79% solvent, and then diluted 20-fold with mineral spirit.

EXAMPLE 3

The copolymer and carbodiimide of Comparative Example C1, and "New Belsoft" which is an alkylketen dimer (AKD) manufactured by Nippon Oil & Fats Co., Ltd. were added, at 40° C., to 1,1,1-trichloroethane, in a weight ratio of 10% copolymer, 1% carbodiimide, 2% alkylketen dimer, and 87% solvent, and then diluted 20-fold with mineral spirit.

EXAMPLE 4

The copolymer and carbodiimide of Comparative Example C1, and aluminum sec-butylate (metal alcoholate) were added as in Comparative Example C1 to 1,1,1-trichloroethane, in a weight ratio of 10% copolymer, 1% carbodiimide, 3% metal alcoholate, and 86% solvent, and then diluted 20-fold with mineral spirit.

EXAMPLE 5

The copolymer and carbodiimide of Comparative Example C1, and "Paberus NP" an alkenyl succinic anhydride (ASA) were added as in Comparative Example C1 to 1,1,1-trichloroethane, in a weight ratio of 10% copolymer, 1% carbodiimide, 2% alkenyl succinic anhydride (ASA) and 87% solvent, and then diluted 20-fold with mineral spirit.

EXAMPLE 6

The copolymer, carbodimmide, and plasticizer of Example 1g, Zirconium octylate and "SH200 (10CPS)" which is a silicone oil manufactured by Toray Silicone Co., Ltd. were added as in Comparative Example C1 to 1,1,1-trichloroethane, in a weight ratio in 10% copolymer, 1% carbodiimide, 5% plasticizer, 10% zirconium salt, 20% silicone oil, and 54% solvent, and then diluted 20-fold with mineral spirit.

COMPARATIVE EXAMPLE C2

The copolymer of COMPARATIVE EXAMPLE C1 was added as in COMPARATIVE EXAMPLE C1 to 1,1,1-trichloroethane, in a weight ratio of 10% copolymer and 90% solvent, and then diluted 20-fold with mineral spirit.

COMPARATIVE EXAMPLE C3

The copolymer of COMPARATIVE EXAMPLE C1 and the silicon oil of Example 6 were added as in Comparative Example C1 to 1,1,1-trichloroethane, in a weight ratio in 10% copolymer, 10% silicon oil, and 90% solvent, and then diluted 20-fold with mineral spirit.

A standard fabric of 100% silk for the JIS color fastness test was dipped in the resulting processing solution, squeezed with a mangle and dried at 80° C. in a hot-air dryer for 5 minutes. Test results of the trated fabric are shown in Table 3.

TABLE 3

| | Composition of water- and oil-repellent agent (components ratio) | Water-repellency Initial | Water-repellency After dry cleaning | Initial Oil-repellency | Initial Feeling |
|---|---|---|---|---|---|
| Examples | | | | | |
| 1 | Copolymer/Carbodiimide/Plasticizer (10/1/5) | 100 | 70 | 6 | 3 |
| 2 | Copolymer/Carbodiimide/Zirconium salts (10/1/10) | 100 | 70 | 6 | 3 |
| 3 | Copolymer/Carbodiimide/AKD (10/1/2) | 100 | 70 | 6 | 3 |
| 4 | Copolymer/Carbodiimide/Metal alcoholate (10/1/5) | 100 | 70 | 5 | 3 |
| 5 | Copolymer/Carbodiimide/ASA (10/1/2) | 100 | 70 | 6 | 3 |
| 6 | Copolymer/Carbodiimide/Plasticizer/ Zirconium salt/SH200 (10/1/5/10/20) | 100 | 70 | 5 | 4 |
| Comparative Examples | | | | | |
| C1 | Copolymer/Carbodiimide (10/1) | 90 | 70 | 6 | 3 |
| C2 | Copolymer | 80 | 0–50 | 5 | 3 |
| C3 | Copolymer/SH200 (1/2) | 80 | 0–50 | 1 | 4 |

Indication of feeling
4 softer than 100% silk fabric before the processing
3 the same with 100% silk fabric before the processing
2 slightly harder than 100% silk fabric before the processing
1 harder than 100% silk fabric before the processing As can be seen from the results in Table 3, the examples of the present invention impart water- and oil-repellency with higher dry cleaning resistance than that of the conventional agents, to silk products at a relatively low temperature of 80° C. or below. It has been considered conventionally that silicone compounds cannot be used with fluorine-type water- and oil-repellent agent because silicone compounds induce lower oil-repellency. However, in the invention, silicone compounds can be added to the treatment agent, to give softer feeling without the damage of the other effects including oil-repellency, and the combination use prevents treated products from being tinged yellow. The water- and oil-repellent agents of the present invention exert excellent effect when applied to not only silk products but also products of natural fibers such as wool, cotton, hemp, etc., regenerated fibers such as rayon, and leather product.

Furthermore, applicable product forms include sheet-like products such as fabric, non-woven fabric, web, and also thread, yarn, cotton, wool, etc.

The performance of compositions of fluorochemical polymers and carbodiimides are surprisingly improved by the addition of other water-repellent extenders or softners. To further demonstrate these findings, the following compositions were prepared.

COMPARATIVE EXAMPLE C4

The copolymer and carbodiimide of Comparative Example C1 were added as in Comparative Example C1 to perchloroethylene in a weight ratio of 0.2% copolymer, 0.5% carbodiimide, and the remainder solvent.

EXAMPLE 7

Prepared as in Comparative Example C4, but also with 0.05 weight % Accosize TM 18, an alkenyl succinic anhydride commercially available from Cyanamid.

EXAMPLE 8

Prepared as in Comparative Example C4, but also with 0.05 weight % aluminum di(secondary butoxide) stearate, commercially available as ABS 55.5 S from Chattem Chemicals.

EXAMPLE 9

Prepared as in Comparative Example C4, but also with 0.05 weight % Episan Topfix TM, a triaziridine commercially available from Henkel.

Comparative Example C4 and Examples 7–9 were used to treat samples of 65% polyesters/35% cotton blend fabric, 100% cotton fabric, and silk fabric. Application was by solvent padding at 100% wet pick-up. Treated samples were dried for 30 minutes at 70° C. If listed in the tables as "ironed", the treated samples were ironed for 15 seconds at 150° C. The samples were tested for water-repellency spray rating (SR) under JIS L-100S, and oil repellency (OR) under AATTC 119 1981. The results are shown in Tables 4–6.

TABLE 4

| 65/35 POLYESTER/COTTON | Not ironed OR | Not ironed SR | Ironed OR | Ironed SR |
|---|---|---|---|---|
| Comparative Example C4 | 5+ | 80 | 5+ | 90 |
| Example 7 | 6 | 95 | 6 | 100 |
| Example 8 | 6 | 90 | 6 | 95 |
| Example 9 | 6 | 95 | 5 | 100 |

TABLE 5

| 100% COTTON | Not ironed OR | Not ironed SR | Ironed OR | Ironed SR |
|---|---|---|---|---|
| Comparative Example C4 | 5 | 80 | 5 | 90 |
| Example 7 | 6 | 85 | 6 | 90 |
| Example 8 | 6 | 80 | 6 | 90 |

TABLE 5-continued

| | 100% COTTON | | | |
|---|---|---|---|---|
| | Not ironed | | Ironed | |
| | OR | SR | OR | SR |
| Example 9 | 5 | 85 | 5 | 95 |

TABLE 6

| | SILK | |
|---|---|---|
| | Not ironed | |
| | OR | SR |
| Comparative Example C4 | 3+ | 90 |
| Example 7 | 4 | 100 |
| Example 8 | 3 | 95 |
| Example 9 | 4 | 100 |

COMPARATIVE EXAMPLE C5

The copolymer of Comparative Example C1 was added to 1,1,1-trichloroethane in a weight ratio of 0.25% by weight polymer (remainder 99.75% solvent).

COMPARATIVE EXAMPLE C6

The copolymer and carbodiimide of Comparative Example C1 were added as in Comparative Example C1 to 1,1,1-trichloroethane, in a weight ratio of 0.25% polymer, 0.07% carbodiimide, and remainder solvent.

EXAMPLE 10

To the solution of Comparative Example C6 was added 0.05% by weight Accosize TM 18, an alkenyl succinic anhydride available from Cyanamid.

EXAMPLE 11

To the solution of Comparative Example C6 was added 0.05% by weight ABS 55.5 S, aluminum di(-secondary butoxide) stearate available from Chattem Chemicals.

EXAMPLE 12

To the solution of Comparative Example C6 was added 0.05% by weight Episan Topfix TM, a tri-aziridine available from Henkel.

Comparative Examples C5 and C6, and Examples 10–12 were used to treat 65% polyester (PES)/35% cotton blend fabric, and 100% cotton fabric.

These mixtures were sprayed onto PES/cotton and cotton substrates. The application level was 15 g solution on a 30×20 cm substrate. Substrates were dried at room temperature and conditioned 24 hours before testing. The results are shown in Table 7.

TABLE 7

| | PES/Cotton | | Cotton | |
|---|---|---|---|---|
| | OR | SR | OR | SR |
| Comparative Example C5 | 4 | 70 | 2 | 70 |
| Comparative Example C6 | 3 | 95 | 2 | 90 |
| Example 10 | 4 | 100 | 3 | 100 |
| Example 11 | 4 | 100 | 3 | 100 |
| Example 12 | 4 | 100 | 2 | 100 |

As can be seen by the experimental results, the examples of the present invention can be used to produce treated fibrous substrates with better oil- and water-repellency than conventional mixtures. The compositions of this invention can be used to treat a variety of fibrous substrates, and can impart desired oil- and water repellency after drying at room temperature without additional heat-curing.

The various modifications and alterations of this invention will be apparent to those skilled in the art without departing from the scope and spirit of this invention and this invention should not be restricted to that set forth herein for illustrative purposes.

We claim:

1. A water- and oil-repellent treating agent for fibrous substrates comprising a fluorochemical type water- and oil-repellent agent, a carbodiimide compound, and at least one component selected from the group consisting of plasticizer, an aluminum zirconium, or titanium metal ester or alcoholate, aziridine, zirconium salt, alkylketen dimer, alkenyl succinic anhydride.

2. The treating agent of claim 1 wherein said carbodiimide is a multi-functional aliphatic hydrocarbon carbodiimide.

3. The treating agent of claim 1 wherein said plasticizer is selected from the group consisting of di-(2-ethylhexyl)azelate, dioctyladipate, dioctylazelate, and di-(2-ethylhexyl)maleate.

4. The treating agent of claim 1 wherein said metal ester or alcoholate is selected from the group consisting of aluminum isopropylate, mono-sec butoxyaluminium, di-isopropylate, aluminium sec-butylate, aluminium ethylate, aluminium sec-butylate, zirconium butylate, and zirconium propylate.

5. The treating agent of claim 1 wherein said zirconium salt is selected from the group consisting of zirconylacetate, n-zirconyl propionate, n-zirconyl butylate, n-zirconyl valerate, n-zirconylhexanate, n-zirconyl peptanate, zirconyl octylate, zirconyl stearate, and others.

6. The treating agent of claim 1 wherein said alkenyl succinic anhydride is n-octenyl succinic anhydride or octadecenyl succinic anhydride.

7. The treating agent of claim 1 wherein said aziridine is selected from the group consisting of beta-aziridinyl methylmethacrylate, n-cyanoethylethyleneimine, octadecyl ethyleneurea, trimethylol propanetris [3-(1-aziridinyl) propionateg], trimethylolpropanetris [3-(1-aziridinyl)butylateg], trimethylolpropanetris [3-(1-2-methyl) aziridinyl propionate], trimethylolpropanetris [3-(1-aziridinyl)-2-methylpropionate], pentaerythritoltris [3-(1-aziridinyl) propionate], pentaerythritoltris [3-(1-(2-methyl) aziridinyl) propionateg], diphenylmethane-4,4'-bis-N N-ethyleneurea, 1,6-hexa-methylene-bis-N N -ethyleneurea, 2,4,6-(triethyleneimino)-syntriazine, bis [1-(2-ethyl)aziridinyl]bezen-1 3-dicarboxylate, 1,6-hexamethylene diethyleneurea, diphenylmethane-bis-4,4'-N N -diethyleneurea, 1,1,1-tri(beta-aziridinylpropionyloxymethyl) propane.

8. The treating agent of claim 1 wherein said alkylketen dimer is n-octadecyl alkylketen dimer.

9. The treating agent of claim 1 wherein said carbodiimide is present at 1% to 25% by weight based on weight of said fluorochemical.

10. The treating agent of claim 1 further comprising a silicone type compound.

11. Method of treating fibrous substrates comprising:

A) contacting said fibrous substrate with a solution comprising a fluorochemical type water- and oil-repellent agent, carbodiimide compound and at least one component selected from the group consisting of plasticizer, or aluminum, zirconium, or titanium metal ester or alcoholate, aziridine, zirconium salt, alkylketen dimer, alkenyl succinic anhydride;

B) drying the substrate resulting from Step A.

12. The method of claim 11 wherein said drying is accomplished below 90° C.

13. The method of claim 11 wherein said drying is accomplished below 30° C.

14. The method of claim 11 wherein said carbodiimide is a multi-functional aliphatic hydrocarbon carbodiimide.

15. The method of claim 11 wherein said plasticizer is di-(2-ethylhexyl)azelate or di-(2-ethylhexyl)maleate.

16. The method of claim 11 wherein said metal ester or alcoholate is selected from the group consisting of aluminum isopropylate, mono-sec butoxyaluminium, di-isopropylate, aluminium sec-butylate, aluminium ethylate, aluminium sec-butylate, zirconium butylate, and zirconium propylate.

17. The method of claim 11 wherein said zirconium salt is selected from the group consisting of zirconylacetate, n-zirconyl propionate, n-zirconyl butylate, n-zirconyl valerate, n-zirconylhexanate, n-zirconyl peptanate, zirconyl octylate, zirconyl stearate.

18. The method of claim 11 wherein said alkenyl succinic anhydride is n-octenyl succinic anhydride or octadecenyl succinic anhydride.

19. The method of claim 11 wherein said aziridine is selected from the group consisting of beta-aziridinyl methylmethacrylate, n-cyanoethylethyleneimine, octadecyl ethyleneurea, trimethylol propanetris [3-(1-aziridinyl) propionate], trimethylolpropanetris [3-(1-aziridinyl)butylateg], trimethylolpropanetris [3-(1-2-methyl) aziridinyl propionateg], trimethylolpropanetris [3-(1-aziridinyl)-2-methylpropionate], pentaerythritoltris [3-(1-aziridinyl) propionate], pentaerythritoltris [3-(1-(2-methyl) aziridinyl) propionate], diphenylmethane-4,4'-bis-N N-ethyleneurea, 1,6-hexa-methylene-bis-N N -ethyleneurea, 2,4,6-(triethyleneimino)-syn-triazine, bis [1-(2-ethyl)aziridinyl]bezen-1 3-dicarboxylate, 1,6-hexamethylene diethyleneurea, diphenylmethane-bis-4,4'-N N -diethyleneurea, 1,1,1-tri(beta-aziridinylpropionyloxymethylg) propane.

20. The method of claim 11 wherein said alkylketen dimer is n-octadecyl alkylketen dimer.

21. The method of claim 11 wherein said carbodiimide is present at 1% to 25% by weight based on weight of said fluorochemical.

22. The method of claim 11 wherein said mixture further comprises a silicone type compound.

23. Fibrous substrate treated with the treating agent of claim 1.

24. The fibrous substrate of claim 23 wherein said fibrous substrate is selected from the group consisting of silk, wool, cotton, leather, hemp, rayon, polyester, and blends thereof.

* * * * *

UNITED STATES PATENT AND TRADEMARK OFFICE

CERTIFICATE OF CORRECTION

PATENT NO. : 5,132,028

DATED : July 21, 1992

INVENTOR(S) : Makoto Nagase, Kathy Allewaert, Franceska Fieuws, Dirk Coppens

It is certified that error appears in the above-indentified patent and that said Letters Patent is hereby corrected as shown below:

Col. 3, lines 10 to 19, that portion of the formula reading

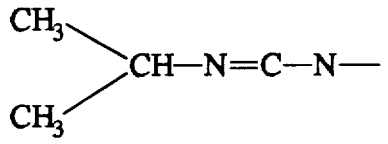

should read

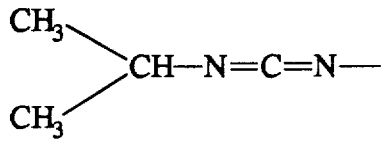

Col. 4, line 65, after "solids" there should be a --.--.

Col. 4, line 67, after "drying" there should be a --.--.

In Claim 1, col. 10, line 13, after "aluminum" there should be a --,--.

In Claim 4, col. 10, line 25, in "butoxyaluminum," delete the ",".

In Claim 7, col. 10, line 41, in "propionateg]" delete the "g".

UNITED STATES PATENT AND TRADEMARK OFFICE

CERTIFICATE OF CORRECTION

PATENT NO. : 5,132,028

DATED : July 21,1992

INVENTOR(S) : Makoto Nagase, Kathy Allewaert, Franceska Fieuws, Dirk Coppens

It is certified that error appears in the above-indentified patent and that said Letters Patent is hereby corrected as shown below:

In Claim 7, col. 10, line 46, "propionateg]" delete the "g".

In Claim 16, col. 11, line 13, "butoxyaluminum," delete the ",".

In Claim 19, col. 12, line 3, in "aziridinyl)butylateg" delete the "g".

In Claim 19, col. 12, line 4, in "propionateg]" delete the "g".

In Claim 19, col. 12, line 13, in "ymethylg) propane" delete the "g".

In Column 10, line 42, in "butylateg]" delete the "g".

Signed and Sealed this

Twelfth Day of July, 1994

*Attest:*

Bruce Lehman

BRUCE LEHMAN

*Attesting Officer*

*Commissioner of Patents and Trademarks*